United States Patent [19]

Kudinov et al.

[11] Patent Number: 4,676,487

[45] Date of Patent: Jun. 30, 1987

[54] COOLING PLATE FOR METALLURICAL FURNACES

[75] Inventors: Gennady A. Kudinov; Evgeny E. Lysenko; Vladimir G. Ioshpa; Alexei I. Tolochko, all of Kharkov; Anatoly A. Shokul, Zhdanov; Ignaty N. Nekrasov, Debaltsevo Donetskoi, all of U.S.S.R.

[73] Assignee: Vnipichermetenergoochistka, Kharkova, U.S.S.R.

[21] Appl. No.: 514,812

[22] PCT Filed: Nov. 16, 1981

[86] PCT No.: PCT/SU81/00077

§ 371 Date: Jun. 27, 1983

§ 102(e) Date: Jun. 27, 1983

[87] PCT Pub. No.: WO83/01792

PCT Pub. Date: May 26, 1983

[51] Int. Cl.[4] ..... C21B 7/10

[52] U.S. Cl. ..... 266/194; 266/193

[58] Field of Search ..... 266/193, 190, 241, 194; 432/238

[56] References Cited

U.S. PATENT DOCUMENTS

| | | | |
|---|---|---|---|
| 3,379,427 | 4/1968 | Zherebin et al. | 266/190 |

FOREIGN PATENT DOCUMENTS

| | | | |
|---|---|---|---|
| 0696325 | 8/1940 | Fed. Rep. of Germany | 266/193 |
| 1925478 | 5/1969 | Fed. Rep. of Germany | 266/190 |
| 0065896 | 10/1972 | Poland | 266/190 |
| 0496289 | 11/1938 | United Kingdom | 266/193 |
| 0595386 | 2/1978 | U.S.S.R. | 266/197 |

OTHER PUBLICATIONS

S. M. Andonjev et al. "Okhlazdenie domennykhpechey," 1972, Mettallurgia (Moskva), p. 217.

*Primary Examiner*—L. Dewayne Rutledge
*Assistant Examiner*—S. Kastler
*Attorney, Agent, or Firm*—Lilling & Greenspan

[57] ABSTRACT

A cooling plate comprises a metallic plate proper provided with openings filled with a refractory material, and a cooling pipe embedded in said plate. The openings extend through the full thickness of the plate and horizontally so that the metallic plate has an S-shaped form. In a vertical plane said openings have the form of a trapezium, and the cooling pipe follows the configuration of the metallic plate.

1 Claim, 2 Drawing Figures

COOLING PLATE FOR METALLURICAL FURNACES

FIELD OF THE INVENTION

The present invention relates to ferrous metallurgy, and particularly to cooling plates for metallurgical furnaces.

The invention may prove most advantageous in cooling metallurgical furnaces, and particularly blast furnaces.

DESCRIPTION OF THE PRIOR ART

Known in the art is a cooling plate for metallurgical furnaces (Polish Patent Specification No. 65,896), comprising a metallic plate proper provided with openings filled with a refractory material, and a cooling pipe built thereinto.

More specifically, the cooling plate comprises a metallic plate provided with ribs or tie-plates disposed at a right angle to the surface thereof and forming blind openings or pockets, the metallic plate proper serving as a bottom portion thereof, while their open portions form a front side facing the furnace chamber. The openings are filled with firebricks.

During operation of the cooling plate of the above construction, there occur thermal stresses in the ribs of tie-plates forming blind openings, said stresses being caused by thermal expansion of the firebricks. Since the above tie-plates are disposed parallel to one another, during the operation of the cooling plate of such a design, bricks crack and fall out, thereby resulting in the formation of a non-uniform thermal field in the body of the metallic plate proper, and in premature damaging thereof. In other words, the service life of such cooling plates is limited.

SUMMARY OF THE INVENTION

The invention resides in a cooling plate for metallurgical furnaces, wherein, due to equalizing the temperature (thermal) field through the metallic portion thereof, the rate of heat removal is increased and thermal stresses in the metallic portion of the plate are decreased, thereby increasing the service life of the cooling plate.

The object set forth is attained in a cooling plate for metallurgical furnaces, comprising a metallic plate proper provided with openings filled with a refractory material, and a cooling pipe built thereinto. According to the invention said openings extend horizontally through the plate thickness so that the metallic plate is S-shaped, said openings having the form of a trapezium in the vertical plane, and the cooling pipe follows the configuration of said metallic plate.

During the operation of such a cooling plate, due to the fact that in the metallic plate proper the openings extend horizontally through the plate thickness so that the metallic plate is S-shaped, there is ensured uniform and intensive cooling of the metallic portion thereof. Since in the vertical plane the openings have the form of a trapezium, if the plate is mounted so that the trapezium is directed with the smaller base thereof into the furnace chamber, openings are held therewithin even after the damage of the lining, the firebricks in said. Since the cooling pipe follows, the configuration of the metallic plate proper, during the operation of the inventive structure, the intensity of heat removal in this metallic plate proper is increased, thermal stresses are reduced, wear resistance of the cooling plate is improved, and consequently the service life thereof is prolonged.

BRIEF DESCRIPTION OF THE DRAWINGS

The invention is further explained in terms of a specific example of an embodiment thereof with reference to the accompanying drawings, in which.

DETAILED DESCRIPTION OF THE INVENTION

Figure 1:
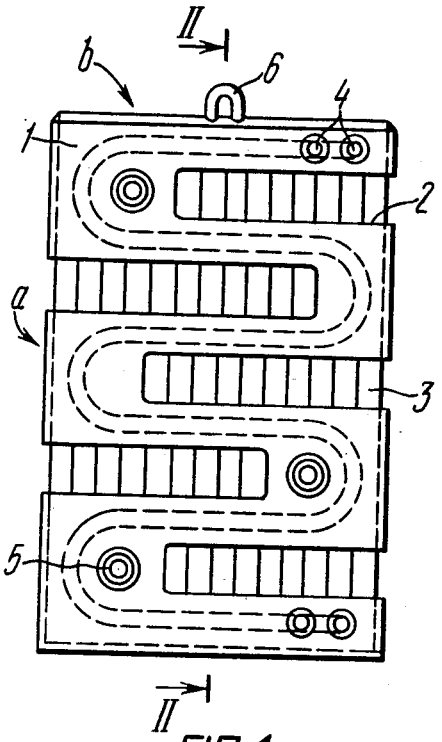
FIG. 1 is a rear view of a cooling plate of the invention.

A cooling plate comprises a metallic plate 1 proper having, for mounting considerations, a vertical side a and a horizontal side b. The metallic plate 1 may be constructed from such ferrous alloys as cast iron and steel, and from such alloys of non-ferrous metals as copper, bronze, etc. Openings 2 are made through the thickness of the plate 1 and horizontally extending. As can be seen in FIG. 1, the openings 2 do not cover the whole width of the plate 1. As a result, the metallic plate 1 is S-shaped. In the vertical plane the openings 2 have the form of a trapezium which is to be directed at its smaller base into the furnace chamber. The openings 2 are filled with a refractory material 3. Firebricks, refractory blocks or refractory packing mass may be utilized as the refractory material 3. Filling said openings may be carried out using such conventional methods as pouring hot metal on bricks or blocks by laying bricks or blocks, or packing with a refractory mass.

A cooling pipe (in the given example two pipes 4), which follows the configuration of the metallic plate 1, is built into said metallic plate 1 encompassing the openings 2. The cooling pipes 4 are disposed substantially at an equal distance from the edges of the plate 1 or at an equal distance from heat receiving surfaces of the plate 1, thereby providing for the equalization of the heat front.

Figure 2:
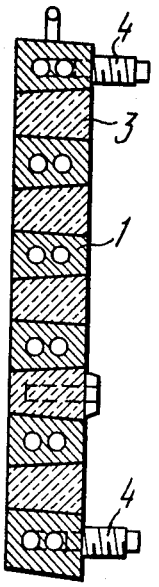
FIG. 2 is a sectional view of a cooling plate of the invention along the line 2—2 in FIG. 1.

As can be seen in FIGS. 1 and 2, the plate 1 is provided with a port 5 for passing mounting bolts, and with a mounting clip 6.

Thus, in operation of the cooling plate of the invention there is ensured more uniform and intensive heat removal accomplished by a cooling liquid circulating within the pipes, thereby increasing the service life of the cooling plate. It should be noted that in spite of a more intensive cooling of the metallic portion of the plate, the total heat lost by the cooling plate is decreased 1.4 to 1.5 times which fact leads to cutting down the consumption of fuel, e.g. coke in blast furnaces.

INDUSTRIAL APPLICABILITY

The invention may be used most advantageously for cooling metallurgical furnaces.

We claim:

1. A cooling plate for metallurgical furnaces, comprising a metallic plate provided with openings filled with a refractory material, and a cooling pipe embedded in said metallic plate, wherein the improvement comprises said openings extending horizontally through the thickness of the plate and the metallic plate having a S-shaped form, said openings having the form of a trapezium in a vertical plane, and the cooling pipe follows the configuration of said metallic plate.

* * * * *